United States Patent [19]

White et al.

[11] Patent Number: 4,706,746

[45] Date of Patent: Nov. 17, 1987

[54] DOWNHOLE INFLATABLE PACKER PUMP AND TESTING APPARATUS

[75] Inventors: Kevin M. White, Jupiter, Fla.; Harold K. Beck, Duncan, Okla.

[73] Assignee: Halliburton Company, Duncan, Okla.

[21] Appl. No.: 924,250

[22] Filed: Oct. 27, 1986

[51] Int. Cl.[4] ..... E21B 33/124; E21B 43/12

[52] U.S. Cl. ..... 166/106; 166/127; 417/395

[58] Field of Search ..... 166/250, 68, 105, 106, 166/187, 191, 127, 130, 183; 417/395; 415/26

[56] References Cited

U.S. PATENT DOCUMENTS

| | | | |
|---|---|---|---|
| 2,690,224 | 9/1954 | Roberts | 166/120 |
| 2,952,217 | 9/1960 | Lindbom | 417/395 |
| 3,083,774 | 4/1963 | Peters et al. | 166/187 |
| 3,291,219 | 12/1966 | Nutter | 166/145 |
| 3,439,740 | 4/1969 | Conover | 166/250 |
| 3,637,328 | 1/1972 | Kurokawa et al. | 417/395 |
| 3,692,433 | 9/1972 | Finger | 412/395 |
| 3,876,000 | 4/1975 | Nutter | 166/106 |
| 3,876,003 | 4/1975 | Kisling, III | 166/250 |
| 3,926,254 | 12/1975 | Evans et al. | 166/106 |
| 4,246,964 | 1/1981 | Brandell | 166/106 |
| 4,313,495 | 2/1982 | Brandell | 166/53 |
| 4,320,800 | 3/1982 | Upchurch | 166/106 |
| 4,366,862 | 1/1983 | Brandell | 166/106 |
| 4,372,387 | 2/1983 | Brandell | 166/334 |
| 4,386,655 | 6/1983 | Brandell | 166/106 |
| 4,388,968 | 6/1983 | Brandell | 166/236 |
| 4,412,584 | 11/1983 | Brandell | 166/169 |
| 4,457,367 | 7/1984 | Brandell | 166/105 |
| 4,458,752 | 7/1984 | Brandell | 166/187 |
| 4,460,310 | 7/1984 | Plunkett | 415/26 |

OTHER PUBLICATIONS

Northstar Drillstem Testers, Ltd., tool string, shown on p. 11 of the Sep. 1, 1980, edition of *Oilweek*.

*Primary Examiner*—Stephen J. Novosad
*Assistant Examiner*—William P. Neuder
*Attorney, Agent, or Firm*—James R. Duzan; Neal R. Kennedy

[57] ABSTRACT

A downhole inflatable packer pump for use in a testing string. The pump includes an upper mandrel rotatably disposed in a case. The upper mandrel includes a pump cam with a cam slot thereon. A piston cavity is defined between the case and inner mandrel in which a single, sleeve-type piston is reciprocably disposed. A cam roller on the piston engages the cam slot, and as the inner mandrel rotates, the piston is reciprocated. A diaphragm sealingly separates the piston chamber from a pumping chamber. Inlet and outlet check valves with annular resilient lips allow fluid flow into the pumping chamber from the well annulus and out of the pumping chamber into an outlet chamber in communication with the lower portion of the testing string. The piston chamber is filled with a lubricating oil, and pumping action of the reciprocating pump piston causes movement of the oil which is transmitted to the pumping chamber through the diaphragm. An equalizing chamber allows equilization of hydrostatic pressures between the piston chamber and the well annulus. A pressure limited is included for limiting a pressure differential between the pumping chamber and the well annulus to a predetermined level. Fluid from the pumping chamber is not directly bypassed to the well annulus.

18 Claims, 15 Drawing Figures

DOWNHOLE INFLATABLE PACKER PUMP AND TESTING APPARATUS

BACKGROUND OF THE INVENTION

1. Field Of The Invention

This invention relates to downhole testing apparatus having pumps used for inflating inflatable packers, and more particularly, to a testing apparatus with a single piston positive displacement diaphragm inflatable packer pump.

2. Description Of The Prior Art

A known method of testing a well formation is to isolate the formation between a pair of inflatable packers with a flow port therebetween adjacent the formation. The packers are inflated by means of a pump in the testing string which pumps well annulus fluid or mud into the packers to place them in sealing engagement with the well bore. A variety of such pumps are available.

One type of downhole pump is actuated by the vertical reciprocation of the tubing string connected to the pump. Such a pump is disclosed in U.S. Pat. No. 3,876,000 to Nutter and U.S. Pat. No. 3,876,003 to Kisling, III. This method of reciprocation results in many operational problems, and so other pumps have been developed which are operated by rotation of the tubing string relative to the pump structure connected thereto.

One type of rotationally operated pump uses a plurality of vertically reciprocating pistons which are driven by a cam structure. Inlet and outlet valves are positioned adjacent each of the pistons. Typical multiple piston pumps are disclosed in U.S. Pat. No. 3,439,740 to Conover and U.S. Pat. No. 4,246,964 to Brandell, both of which are assigned to the assignee of the present invention. These types of pumps require precise machining and assembly which are relatively expensive and susceptible to damage by impurities in the well fluid. In particular, the valves for such pumps can be relatively easily clogged.

A simpler, sleeve-type pump piston is used in the downhole pump of Evans et al., U.S. Pat. No. 3,926,254, assigned to the assignee of the present invention. This pump uses a plurality of sealing rings of V-shaped cross section for intake and exhaust check valves. In the Evans et al. apparatus, as well as the other pumps described above, the pump piston is in direct contact with the well annulus fluid which because of impurities therein can result in reduced service life.

The downhole pump of the testing apparatus of the present invention uses the more simple sleeve-type pump piston and further includes a diaphragm which separates a piston chamber in which the piston reciprocates from a pumping chamber with inlet and outlet valves therein through which the well fluid is moved to inflate the packers. The piston chamber is filled with a clean hydraulic lubricant which promotes longer life for the pump parts. Back-up piston wiper rings are provided to clean the piston of abrasive particulate in the vent that the diaphragm is ruptured.

Simple inlet and outlet check valves with resilient annular lips are used in the present invention which are not easily clogged or damaged by abrasives in the well fluid. These valves are similar to valves in the Halliburton Omni RS Circulation Valve, assigned to the assignee of the present invention and described in copending application Ser. No. 797,375 filed 11/12/85.

Most of the pumps of the prior art include relief valves which relieve pressure from the pump to the well annulus. A pump without a relief valve is disclosed in U.S. Pat. No. 4,313,495 to Brandell, assigned to the assignee of the present invention. In this pump, a clutch is used which is disengaged when the pump pressure reaches a predetermined level, thus making the pump inoperative.

The present invention utilizes a pressure limiter which vents around the outlet check valve to the packers at the lower end of the testing string rather than to the well annulus.

SUMMARY OF THE INVENTION

The downhole inflatable packer pump of the present invention forms a part of a testing string and is used to pump well annulus fluid for inflating packers adjacent a well formation to be tested. The downhole pump comprises case means attachable to a lower testing string portion and defining a pumping chamber therein and mandrel means connectable to an upper testing string portion for mutual rotation with the upper testing string portion and rotatable within the case means. The mandrel means comprises cam means thereon, and the case means and the mandrel means define a piston chamber therebetween.

The pump further comprises piston means disposed in the piston chamber and having cam follower means thereon for following the cam means and reciprocating the piston means with respect to the case means in response to rotation of the mandrel means with respect to the case means. Spline means prevents rotation of the piston means. Diaphragm means are sealingly positioned between the piston chamber and the pumping chamber and prevent fluid communication therebetween. Fluid movement in the pumping chamber is responsive to fluid movement in the piston chamber caused by movement of the piston means.

Preferably, the piston means is characterized by a single, sleeve-type piston. The piston chamber is sealingly separated from the well annulus and pumping chamber and is filled with a lubricating oil which provides lubrication for the reciprocating piston. The piston means includes flow control means for controlling fluid flow thereby and providing pressure equalization across the diaphragm when the testing string is lowered into and raised out of the well.

The pump assembly means further comprises backup wiper means on the piston means for allowing pumping action to continue even if damage occurs to the diphragm while also wiping the piston means of abrasives. In such an occurrence, the pump will be directly pumping well annulus fluid rather than reciprocating within the lubricating oil.

The pump further comprises inlet check valve means for controlling flow of fluid through inlet passageway means from the well annulus into the pumping chamber and outlet check valve means for controlling fluid flow through outlet passageway means out of the pumping chamber toward the lower testing string portion and packers. The inlet check valve means is preferably characterized by a check valve with a resilient valve portion having an annular lip thereon sealingly engaged with a surface of the pumping chamber when the inlet valve is in the closed position. The outlet check valve means is preferably characterized by an outlet valve having a resilient valve portion with an annular lip sealingly engaged with a surface of the pumping chamber when in a closed position.

Pressure equalizing means are provided for equalizing hydrostatic pressure of fluid in the piston chamber with hydrostatic pressure of fluid in the pumping chamber. The pressure equalizing means is characterized by an equalizing piston reciprocably disposed in an equalizing chamber defined between the case means and mandrel means.

The downhole pump further comprises pressure limiting means for limiting a pressure differential between the pumping chamber and the well annulus to a predetermined level. When the pressure differential exceeds this level, the pressure limiting means will move to an open position in which the outlet check valve means is bypassed and the pumping chamber is in continuous direct communication with the lower tool string portion. When this occurs, operation of the pump can still take place, although fluid flow and compression cease.

An important object of the present invention is to provide a downhole pump with piston means reciprocating in a piston chamber sealingly separated from a pumping chamber by a diaphragm means.

Another object of the invention is to provide a diaphragm pump with a piston chamber filled with a lubricating fluid.

An additional object of the invention is to provide a pump with inlet and outlet check valves having resilient valve portions with annular lips thereon sealingly engaging separate surfaces of a pumping chamber when the valves are in closed positions.

A further object of the invention is to provide pressure equalizing means for equalizing the hydrostatic pressure of fluid in a piston chamber of the pump with hydrostatic pressure in fluid in a sealingly separated pumping chamber of the pump.

Still another object of the invention is to provide a pump with pressure limiting means for limiting a pressure differential between a pumping chamber in the pump and the well annulus to a predetermined level.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1A:
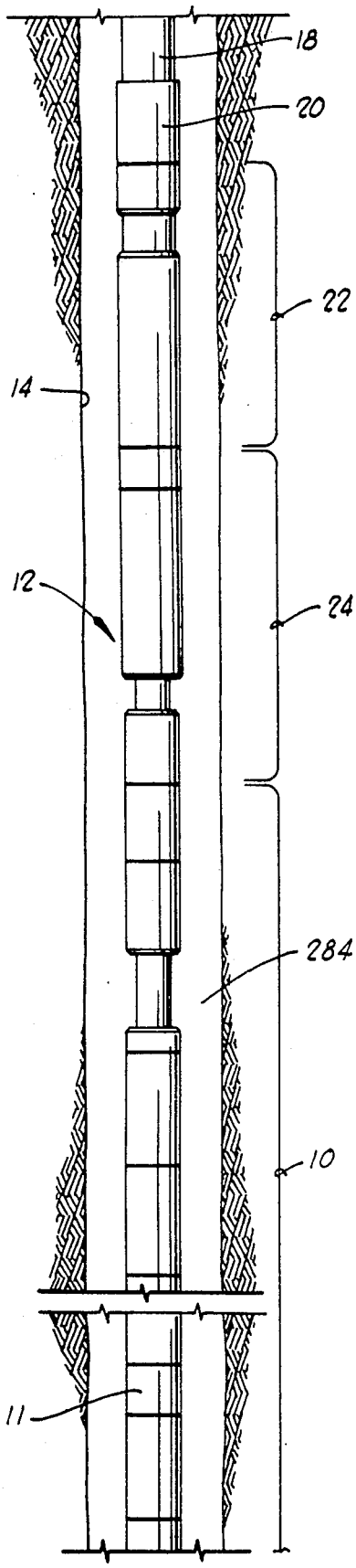
FIGS. 1A–1B show the downhole inflatable packer pump and testing apparatus of the present invention in position in a well bore for testing a well formation.
Figure 1B:
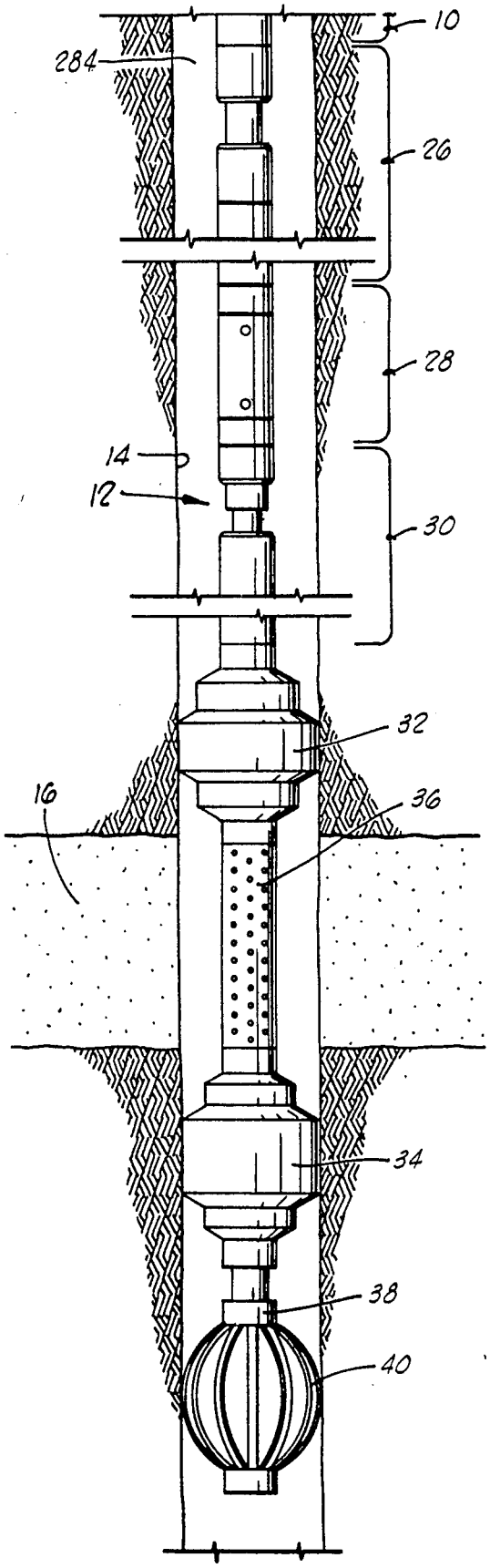

Referring now to the drawings, and more particularly to FIGS. 1A–1B, the present invention includes an inflatable packer pump, generally designated by the numeral 10, having a pressure limiter means, generally designated by the numeral 11, which form part of a testing string or tool 12. Testing string 12 is shown in position in a well bore 14 for use in testing a well formation 16.

Testing apparatus 12 is attached to the lower end of a tool string 18 and includes a reversing sub 20, a testing valve 22 such as the Halliburton Hydrospring ® tester, and an extension joint 24, all of which are positioned above pump 10.

Disposed below pump 10 in testing apparatus 12 are a packer bypass 26, a string bypass 28, and a safety joint 30 such as the Halliburton Hydroflate ® safety joint.

An upper packer 32 is attached to the lower end of safety joint 30 and is disposed above formation 16. A lower packer 34 is positioned below well formation 16. A porting sub 36 interconnects upper packer 32 and lower packer 34. An equalizing tube and spacers (not shown) may also be used between upper packer 32 and lower packer 34 depending upon the longitudinal separation required therebetween.

Upper packer 32 and lower packer 34 are inflatable by pump 10 in a manner hereinafter described such that the packers may be placed in sealing engagement with well bore 14, thus isolating well formation 16 so that a testing operation may be carried out.

A gauge carrier 38 is attached to the lower end of lower packer 34 and includes a plurality of drag springs 40 which are adapted to engage well bore 14 and preventing rotation of a portion of testing apparatus 12 during inflation of upper packer 32 and lower packer 34, as hereinafter described.

Referring now to FIGS. 2A–2F, the details of pump 10 are shown. Pump 10 generally includes upper adapter means 42 defining a longitudinally central opening 44 therethrough. Upper adapter means 44 includes a top adapter 46 with an internally threaded upper end 48 adapted for attachment to an upper portion of testing apparatus 12 above pump 10. Forming a lower part of upper adapter means 42 is a torque case 50 attached to a lower end of top adapter 46 at threaded connection 52.

Pump 10 also includes outer case means 54, spaced below upper adapter means 42, which defines a central opening 56 therethrough. An inner, upper mandrel means 58 interconnects upper adapter means 42 and case means 54 and extends into central openings 44 and 56, respectively.

Upper mandrel means 58 includes a torque mandrel 60 having an outer surface 62 slidingly received in bore 64 of top adapter 46, and a seal 66 provides sealing engagement therebetween.

Torque case 50 has an internally splined portion 68 with an inwardly directed annular shoulder 69 at the lower end thereof. Splined portion 68 is engaged with an externally splined portion 70 on torque mandrel 60. It will thus be seen that relative longitudinal movement between upper adapter means 42 and upper mandrel means 58 is possible while relative rotation therebetween is prevented by the mutual engagement of spline portions 68 and 70. Torque case 50 also has a plurality of downwardly directed lugs 71 at the lower end thereof.

The upper end of a floating piston mandrel 72 is threadingly engaged with the lower end of torque mandrel 60 at threaded connection 74. Sealing is provided between floating piston mandrel 72 and torque mandrel 60 by means of a seal 76. Floating piston mandrel 72 extends downwardly out of central opening 44 of upper adapter means 42 and into central opening 56 of case means 54. The upper end of floating piston mandrel 72 has an outer surface 78 in close, sliding relationship with bore 80 of the lower end of torque case 50.

At the upper end of case means 54 is a piston cap 82 attached to a floating piston case 84 at threaded connection 86. Piston cap 82 has a first bore 88 in closed spaced relationship with an outer surface 90 of an intermediate portion of floating piston mandrel 72. A seal 92 is provided therebetween. Outwardly spaced from outer surface 90 of floating piston mandrel 72 is a second bore 94 which is communication with a transverse hole 96 in piston cap 82. Piston cap 82 also a plurality of upwardly directed lugs 98 at the upper end thereof. Lugs 98 are dimensioned to be engageable with lugs 71 on torque case 50 when desired, as will be discussed in more detail herein.

Figure 2A:
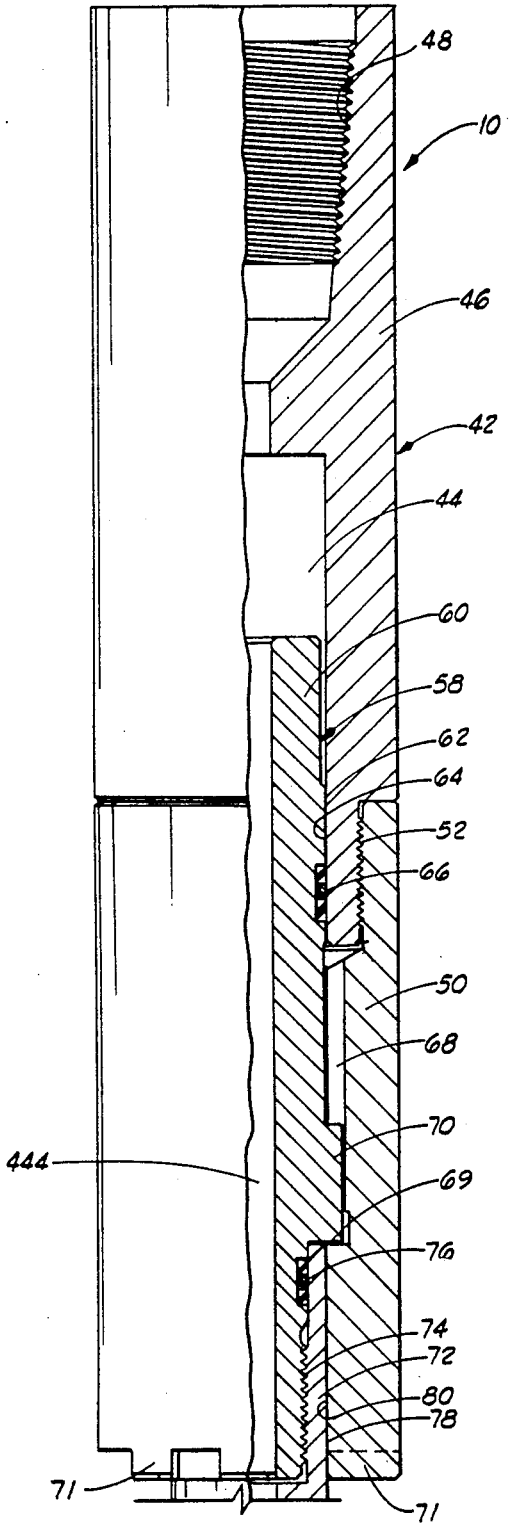
FIGS. 2A–2F show a partial longitudinal cross section of the downhole pump including pressure limiter means.
Figure 2B:
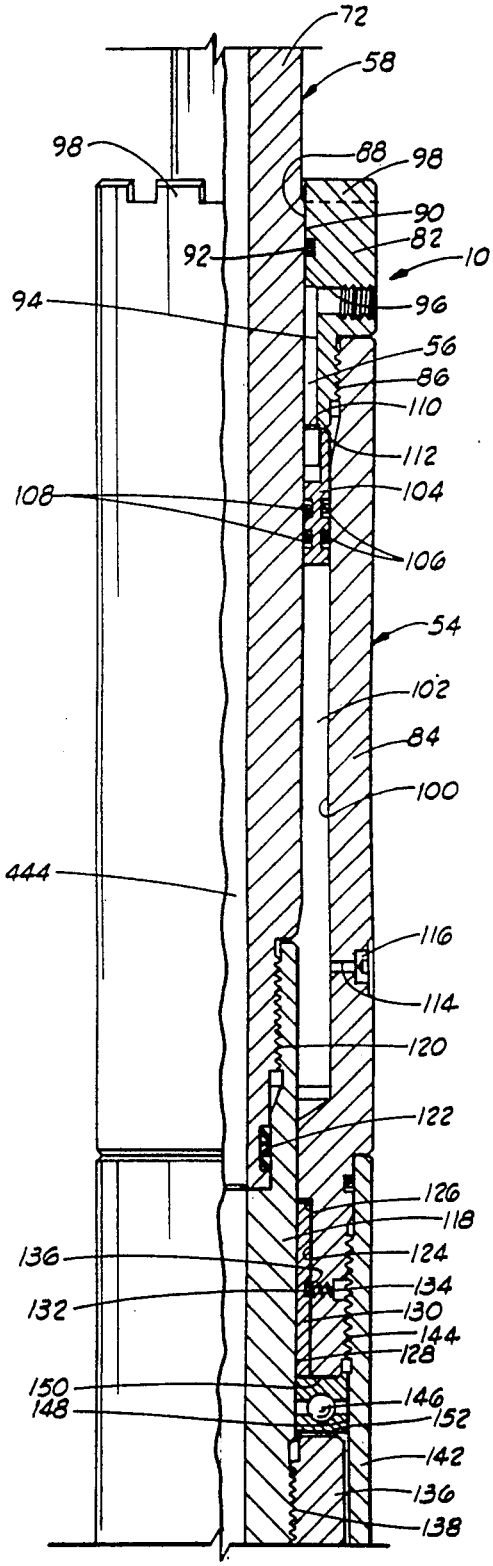

Floating piston case 84 has an inner bore 100 which is outwardly spaced from outer surface 90 of floating piston mandrel 72 such that an annular equalizing chamber 102 is defined therebetween. Reciprocably disposed in equalizing chamber 102 in an annular, floating equalizing piston 104. Piston rings 106 seal between equalizing piston 104 and bore 100 of floating piston case 84, and piston rings 108 seal between the equalizing piston and outer surface 90 of floating piston mandrel 72. As shown in FIG. 2B, an upper end 110 of equalizing piston 104 is engaged with a downwardly facing shoulder 112 on piston cap 82, thus defining an upwardmost position of the equalizing piston. As more fully described hereinafter, equalizing piston 104 is free to reciprocate in equalizing chamber 102 as determined by the differential pressure across the piston.

Floating piston case 84 has a transverse hole 114 therein which is in communication with equalizing chamber 102. Equalizing chamber 102 may be filled with a lubricating oil through transverse hole 114. After filling with oil, hole 114 is closed by plug 116.

The lower end of floating piston mandrel 72 is attached to a bushing mandrel 118 at threaded connection 120. Sealing engagement is provided between floating piston mandrel 72 and bushing mandrel 118 by a seal 22.

The lower end of floating piston case 84 defines a bore 124 with a shoulder 126 at the upper end of the bore. Bore 124 is outwardly spaced from outer surface 128 of bushing mandrel 118 such that a cavity is defined therebetween in which is positioned an annular bushing 130. A set screw 132 is threadingly disposed in a transverse hole 134 in floating piston case 84. Set screw 132 lockingly engages a radially outer groove 136 in bushing 130 for locking the bushing in place with respect to floating piston case 84. Upper mandrel means 58 is adapted for rotation within central cavity 56 of case means 54, and it will be seen by those skilled in the art that bushing 130 provides radial support and alignment for upper mandrel means 58.

Figure 2C:
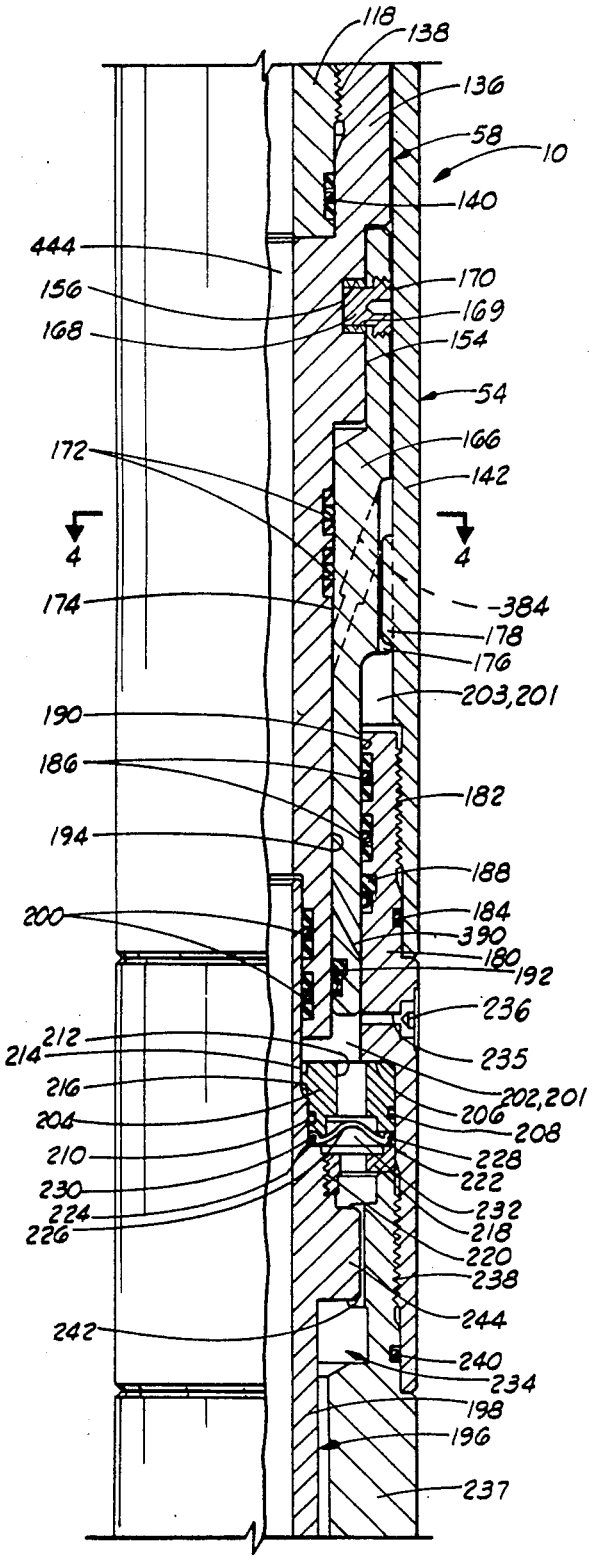

Referring now also to FIG. 2C, the lower end of bushing mandrel 118 is connected to a pump cam 136 at threaded connection 138. A seal 140 is provided for sealing between bushing mandrel 118 and pump cam 136. The lower end of floating piston case 84 is attached to splined piston case 142 at threaded connection 144. It will be seen that splined piston case 142 covers set screw 132.

A thrust bearing 146 is annularly disposed between outer surface 128 of bushing mandrel 118 and bore 148 in splined piston case 142 and longitudinally between a downwardly facing shoulder 150 on floating piston case 84 and an upwardly facing shoulder 152 on pump cam 136. Thrust bearing 146 absorbs longitudinal loading between upper mandrel means 58 and case means 54 while still allowing relative rotation therebetween.

Figure 3:
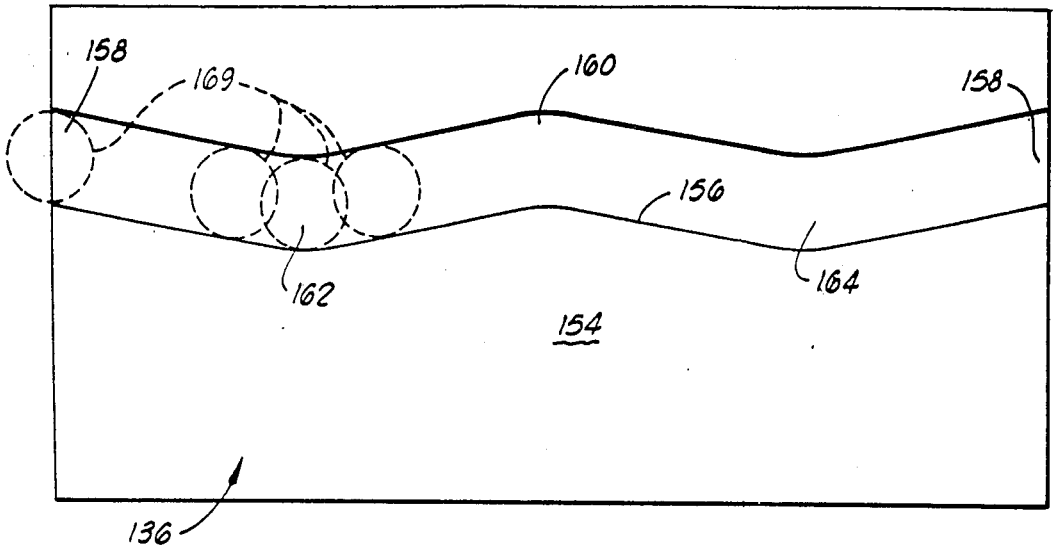
FIG. 3 is a 360° elevation of the pump cam.

Pump cam 136 has an intermediate substantially cylindrical outer surface 154 which defines a substantially annular cam slot 156 therein. In the 360° view of outer surface 154 shown in FIG. 3, it will be seen that cam slot 156 has two upper portions 158 and 160 and two lower portions 162 and 164.

Still referring also to FIG. 2C, annularly disposed between pump cam 136 and splined piston case 142 is a piston means, preferably in the form of a single, sleeve-type pump piston 166. A cam follower pin 168 with a cam roller 169 thereon is transversely positioned on pump piston 166 and affixed thereto at threaded connection 170. Cam follower pin 168 extends radially inwardly into cam slot 156 on pump cam 136. Cam roller 169 fits freely on cam follower pin 168 and is guided by cam slot 156. Cam roller 169 is shown in various positions along cam slot 156 in FIG. 3. Seals 172 provide sealing between pump cam 136 and inner surface 174 of pump piston 166.

The outer surface of pump piston 166 includes a plurality of outer splines 176 which engage inner splines 178 in splined piston case 142. Thus, pump piston 166 is prevented from relative rotation with respect to splined piston case 142, while relative longitudinal movement therebetween is permitted.

The lower end of splined piston case 142 is connected to the upper end of a piston seal case 180 at threaded connection 182. A seal 184 is provided therebetween.

A pair of seals 186 and a wiper ring 188 are provided between piston seal case 180 and outer surface 190 of pump piston 166. Another wiper ring 192 is located between the inside of pump piston 166 and outer surface 194 of pump cam 136. Seals 186 provide a sealing means between pump piston 166 and piston seal case 180. Wiper rings 188 and 192 act as a back-up for cleaning pump piston 166 of mud abrasives in the event of failure of diaphragm 226 hereinafter described. The primary function of wiper rings 188 and 192 is to clean although some sealing action may also occur.

Positioned within case means 54 and below inner, upper mandrel means 58 is an inner, lower mandrel means 196. Forming an upper end of lower mandrel means 196 is a diaphragm mandrel 198. The upper end of diaphragm mandrel 198 is received within the lower end of pump cam 136, and seals 200 are provided therebetween. As will be hereinafter described, upper mandrel means 58 is rotatable with respect to lower mandrel means 196, and thus pump cam 136 is rotatable with respect to diaphragm mandrel 198.

A substantially annular piston chamber 202 is generally defined between pump can 136 of upper mandrel means 58 and splined piston case 142 and piston seal case 180 of case means 54. Piston chamber 201 includes a lower portion 202 and an upper portion 203. As will be hereinafter described, pump piston 166 will longitudinally reciprocate within piston chamber 201 as upper mandrel means 58, and therefore pump cam 136, are rotated. As shown in FIG. 2C, pump piston 166 is at the uppermost point in its stroke in piston chamber 201.

At the lower end of piston chamber 201 and annularly positioned between diaphragm mandrel 198 and piston seal case 180 is a diaphragm clamp 204. The upper end of diaphragm clamp 204 is in contact with annular shoulder 206 in piston seal case 180. An outer seal 208 is positioned between diaphragm clamp 204 and piston seal case 180, and an inner seal 210 is positioned between diaphragm clamp 204 and diaphragm mandrel 198. Diaphragm clamp 204 defines a plurality of longitudinally disposed holes 212 therethrough which form part of lower portion 202 of piston chamber 201.

A plurality of outer splines 214 on piston mandrel 198 are engaged by a plurality of inner splines 216 on the inside of diaphragm clamp 204. Thus, relative rotation between diaphragm clamp 204 and diaphragm mandrel 198 is prevented.

A diaphragm limiter 218 is connected to diaphragm mandrel 198 at threaded connection 220. Diaphragm limiter 218 is positioned below, and spaced from, diaphgram clamp 204.

Diaphragm limiter 218 has an annular, upper shoulder 220, and diaphragm mandrel 198 has an annular, upper shoulder 224 thereon spaced radially inwardly from shoulder 222 on the diaphragm limiter. Shoulders 222 and 224 are preferably substantially aligned longitudinally, but some misalignment is acceptable.

An annular diaphragm 226 is longitudinally positioned between diaphragm clamp 204 and diaphragm limiter 218. Diaphragm 226 has a beaded outer edge 228 which is sealingly clamped between diaphragm clamp 204 and shoulder 222 on diaphragm limiter 218. Similarly, diaphragm 226 has a beaded inner edge 230 which is sealingly clamped between diaphragm clamp 204 and shoulder 224 on diaphragm mandrel 198. Thus, cavity 232 below diaphragm 226 is sealingly separated from piston chamber 202. Diaphragm 226 is preferably formed from a reinforced elastometric material. Cavity 232 forms an upper portion of a pumping chamber, generally designated by the numeral 234.

A transverse hole 235 through piston seal case 180 opens into lower portion 202 of piston chamber 201. Piston chamber 201 may be filled with a lubricating oil through transverse hole 235. After filling, hole 235 is closed with plug 236. A study of FIGS. 2B and 2C will show that upper portion 203 of piston chamber 201 is in communication with equalizing chamber 102. Thus, the entire annular volume below equalizing piston 104 and above diaphragm 226 is filled with oil.

A lower end of piston seal case 180 is connected to an upper end of a splined upper pump breakoff 237 at threaded connection 238. Upper pump breakoff 237 thus forms another portion of case means 54. A seal 240 is provided between piston seal case 180 and upper pump breakoff 237.

Upper pump breakoff 237 has a plurality of inwardly directed splines 242 which are engaged by outwardly directed splines 244 on diaphragm mandrel 196. Thus, relative rotation between diaphragm mandrel 196 and case means 54 is prevented. It will be seen that this prevents relative rotation between lower mandrel means 196 and case means 54.

Figure 2D:
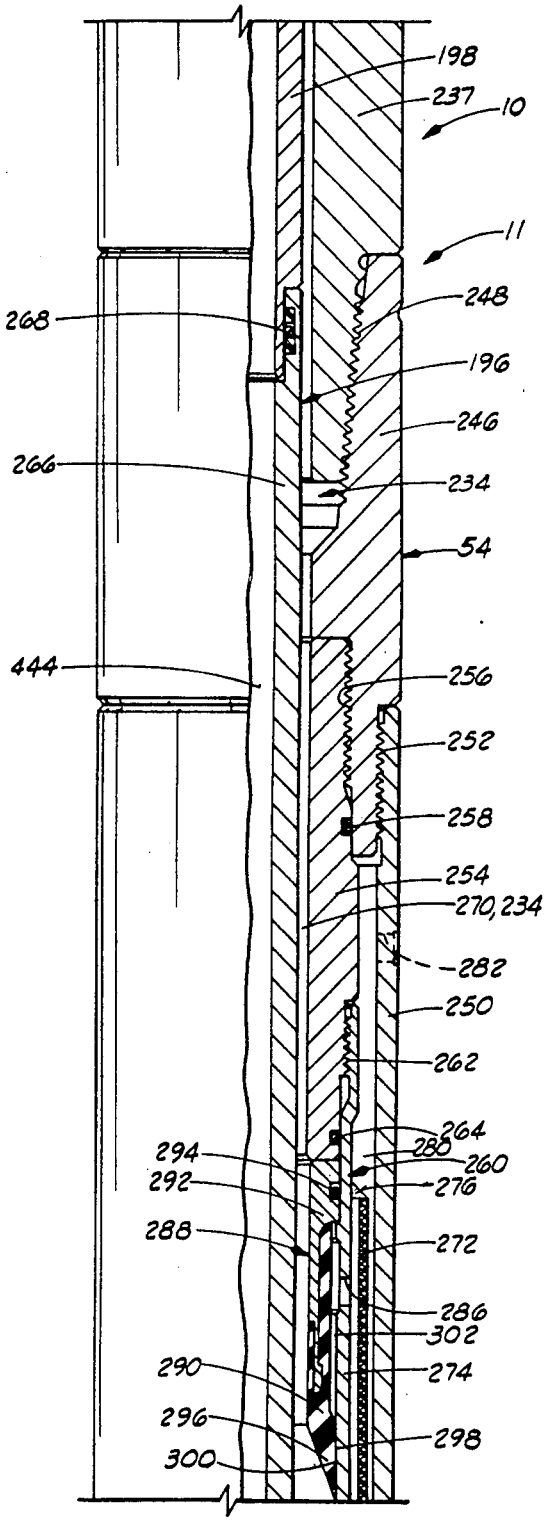

Referring now to FIG. 2D, additional components of case means 54 and lower mandrel means 196 are shown. Upper pump breakoff 237 is connected to bottom pump breakoff 246 at threaded connection 248. An upper end of a pressure limiter case 250 is connected to an outer portion of the lower end of bottom pump breakoff 246 at threaded connection 252. The upper end of a check valve holder 254 is connected to an inner portion of the lower end of bottom pump breakoff 246 at threaded connection 256. A seal 258 is disposed between bottom pump breakoff 246 and check valve holder 254.

The upper end of an intake screen assembly 260 is attached to the lower end of check valve hodler 254 at threaded connection 262. A seal 264 is disposed between intake screen assembly 260 and check valve holder 254.

A lower end of diaphragm mandrel 198 is received in an upper end of pump mandrel 266. A seal 268 provides sealing engagement between diaphragm mandrel 198 and pump mandrel 266. An annular cavity 270 is thus defined between pump mandrel 266 and check valve holder 254. It will be seen that cavity 270 is in communication with cavity 232 and thus forms a portion of pumping chamber 234.

Figure 2E:
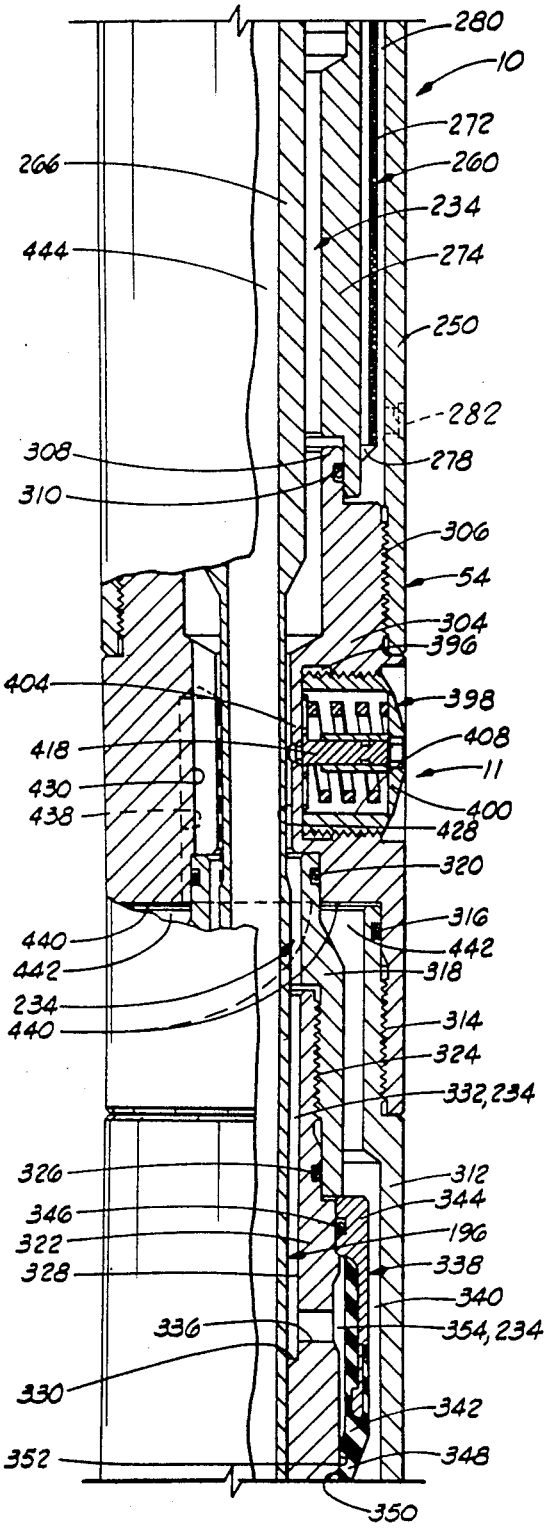

Referring now also to FIG. 2E, it will be seen that intake screen 260 includes an intake screen 272 annularly disposed around, and spaced radially outwardly from, a screen mandrel 274. Intake screen 272 is fixedly attached to screen mandrel 274 such as by upper weld 276 and lower weld 278.

Intake screen assembly 260 is spaced radially inwardly from pressure limiter case 250 such that an annular inlet chamber 280 is defined therebetween. Pressure limiter case 250 defines at least one transverse hole 282 therethrough which provides communication between inlet chamber 280 and well annulus 284 defined between well bore 14 and testing string 12. Well annulus 284 is shown in FIGS. 1A and 1B. Screen mandrel 274 defines at least one transverse hole 286 therethrough and located inside intake screen 272. It will be seen that hole 286 is in communication with well annulus fluid passing through intake screen 272.

As shown in FIG. 2D, inlet check valve means, generally designated by the numeral 288, is provided for allowing well annulus fluid passing through hole 286 to enter pumping chamber 234 when desired, in a manner hereinafter described. Inlet check valve means 288 preferably comprises a resilient valve portion 290 carried by a valve portion carrier 292. Valve portion 290 and valve portion carrier 292 are annularly disposed between intake screen assembly 260 and pump mandrel 266 and longitudinally immediately below check valve holder 254. A seal 294 is provided between valve portion carrier 292 and sleeve mandrel 274 of screen assembly 260. Valve portion 290 has a resilient annular lip 296 having a radially outer surface 298 that is sealingly engaged against radially inner surface 300 of screen mandrel 274. Valve portion 290 is further configured such that an annular space 302 is defined between valve portion 290 and screen mandrel 274. It will be seen that annular space 302 is in communication with hole 286 in screen mandrel 274 and thus in communication with fluid in well annulus 284.

Referring again to FIG. 2E, the lower end of pressure limiter case 250 is connected to a pressure limiter body 304 at threaded connection 306. Pressure limiter body 304 is a major component of one embodiment of pressure limiter means 11, as will be discussed in more detail hereinafter. An upper portion 308 of pressure limiter body 304 extends into the lower end of screen mandrel 274 of intake screen assembly 260. A seal 310 is positioned therebetween.

The lower end of pressure limiter body 304 is connected to a lower check valve case 312 at threded connection 314, and a seal 316 provides sealing engagement therebetween. It will be seen that pressure limiter body 304 and lower check valve case 312 are additional components of case means 54.

Pump mandrel 266 extends longitudinally through pressure limiter body 304 and lower check valve case 312, thus defining additional portions of pumping chamber 234 between pump mandrel 266 and case means 54. Adjacent pressure limiter body 304 and spaced radially outwardly from pump mandrel 266 is a substantially annular check valve retainer 318. A seal is provided between check valve retainer 318 and an intermediate portion of pressure limiter body 304. A lower end of check valve retainer 318 is attached to a check valve seat 322 at threaded connection 324, and a seal 326 is provided therebetween. Check valve seat 322 has an inner bore 328 with an annular shoulder 330 extending radially inwardly therefrom. It will be seen that a cavity 332 is defined between bore 328 of check valve seat 322 and pump mandrel 266. Cavity 332 forms a lowermost part of pumping chamber 234.

Figure 2F:
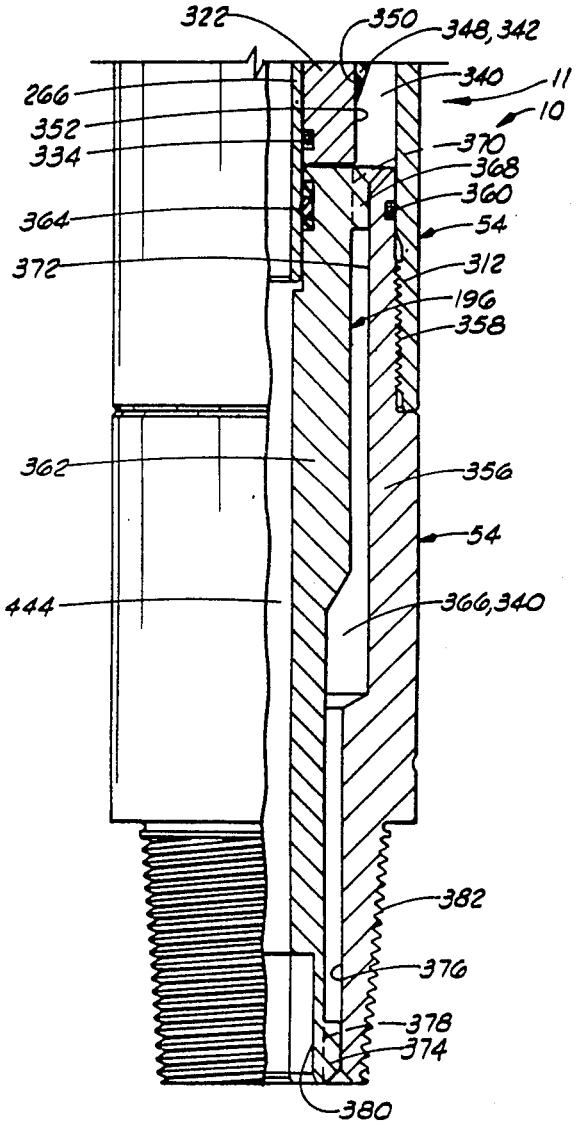

Referring now also to FIG. 2F, a seal 334 is provided between check valve seat 322 and pump mandrel 266 below shoulder 330. Check valve seat 322 defines at least one transverse hole 336 therethrough which is in communication with cavity 332.

Outlet check valve means, generally designated by the numeral 338, is provided for controlling flow of fluid out of pumping chamber 234 into annular outlet chamber 340 defined between case means 54 and lower mandrel means 196 generally below pressure limiter means 11. Outlet check valve means 338 preferably includes a resilient annular valve portion 342 carried by valve portion carrier 344. Valve portion carrier 344 is disposed longitudinally below check valve retainer 318 and annularly between check valve seat 322 and lower check valve case 312. A seal 346 is provided between valve portion carrier 344 and check valve seat 322. Valve portion 342 includes a resilient lip 348 having a radially inner surface 350 which sealingly engages a radially outer surface 352 of check valve seat 322. Valve portion 342 and check valve seat 322 are adapted to define an annular space 354 in fluid communication with hole 336, and thus also forming a portion of pumping chamber 234.

Referring again to FIG. 2F, the lower end of lower check valve case 312 is connected to a lower adapter 356 at threaded connection 358, and a seal 360 is provided therebetween. It will be seen that lower adapter 356 thus forms the lowermost portion of case means 54.

A lower end of pump mandrel 266 is received in an upper end of an adapter mandrel 362. A seal 364 is provided for sealing engagement between pump mandrel 266 and adapter mandrel 362. Adapter mandrel 362 and lower adapter 356 define an annular cavity 366 therebetween. Extending radially outwardly from the upper end of adapter mandrel 362 are a plurality of upper guide lugs 368 which are angularly disposed from one another such that gaps 370 are defined therebetween. Upper guide lugs 368 are in close spaced relationship to first inner bore 372 of lower adapter 356 and guide thereon. At the lower end of adapter mandrel 362 are a plurality of lower guide lugs 374 which are in close spaced relationship to second inner bore 376 of lower adapter 56, and thus guide thereon. Lower guide lugs 374 are angularly displaced from one another such that a plurality of gaps 378 are defined therebetween. It will be seen that because of gaps 370, annular cavity 366 forms a portion of discharge chamber 340.

The lower end of adapter mandrel 362 defines an inner bore 380 and the lower end of the lower adapter 356 has an externally threaded portion 382 which are adapted for engagement with the portion of testing apparatus 12 positioned below pump 10, in a manner known in the art. This lower portion of testing apparatus 12 has an annular passageway therethrough (not shown) in fluid communication with upper packer 32 and lower packer 34. Because of gaps 378, it will be seen that this annular passageway is in fluid communication with discharge chamber 340 in pump 10.

Figure 4:
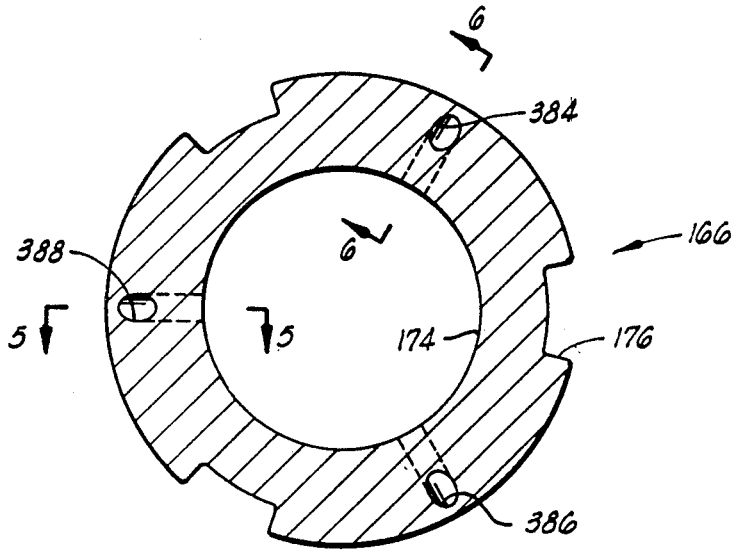
FIG. 4 is a cross-sectional view of the pump piston taken along lines 4—4 in FIG. 2C.

Referring now to FIG. 4, a transverse cross section through the portion of pump piston 166 which includes splines 176 is shown. Three angularly disposed passageways 384, 386 and 388 extend through pump piston 166. As shown in FIG. 2C, passageway 384 opens into inner surface 174 of pump piston 166 at a point below seals 172, even when the pump piston is at the uppermost position. The other end of passageway 384 opens into upper portion 203 of piston chamber 201 adjacent splines 176. Passageways 386 and 388 are similarly located.

Extending angularly through a lower end of pump piston 160 are a plurality of bypass ports 390. In the preferred embodiment, four such ports are used. However, it is not intended that the invention be limited to this number. Each port 390 opens into inner surface 174 of pump piston 166 at a point above wiper ring 192. The other end of each bypass port 390 opens into outer surface 190 of pump piston 166, and thus into lower portion 202 of piston chamber 201, at a point below wiper ring 188, even when the pump piston is at the topmost position shown in FIG. 2C.

It will thus be seen that a fluid path is defined through bypass ports 390, annularly between pump piston 166 and pump cam 136, and through passageways 384, 386 and 388 which provides intercommunication between lower portion 202 and upper portion 203 of piston chamber 201.

Figure 5:
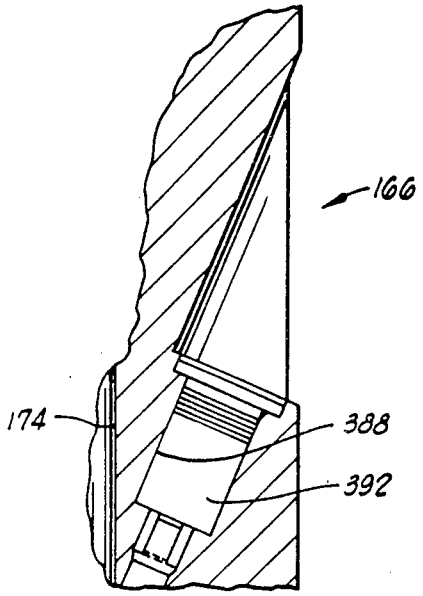
FIG. 5 is a cross section taken along lines 5—5 in FIG. 4 and showing a visco-jet.
Figure 6:
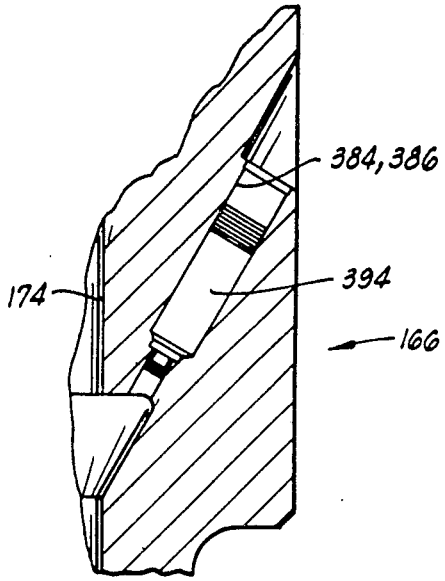
FIG. 6 is a cross-sectional view of the pump piston taken along lines 6—6 in FIG. 4 and showing a one-way check valve.

Obviously, if passageways 384, 386 and 388 were always open, reciprocation of pump piston 166 would have no pumping effect. Therefore, flow control means are provided in passageways 384, 386 and 388 for controlling fluid flow through this fluid path. Referring now to FIGS. 5 and 6, the flow control means includes a visco-jet 392 disposed in passageway 388 and a one-way check valve 394 disposed in each of passageways 384 and 386.

Visco-jet 392 is a highly restricted orifice of a kind known in the art which allows very retarded fluid movement upwardly through passageway 388. Any fluid flow through visco-jet 392 is so small over a short period of time as to have a negligible effect upon the efficiency of pump 10 when pump piston 166 is reciprocating during normal pumping. Check valves 394 are also of a kind known in the art and allow fluid flow downwardly through passageways 384 and 386 while preventing upward fluid flow therethrough. The significance of visco-jet 392 and check valves 394 on the operation of pump 10 will be more fully explained in the discussion of the operation of the invention herein.

Referring again to FIG. 2E, one embodiment of pressure limiter means 11 is shown. In this embodiment, pressure limiter body 304 has a transverse cavity 396 in which is disposed a pressure limiter assembly 398.

Figure 7:
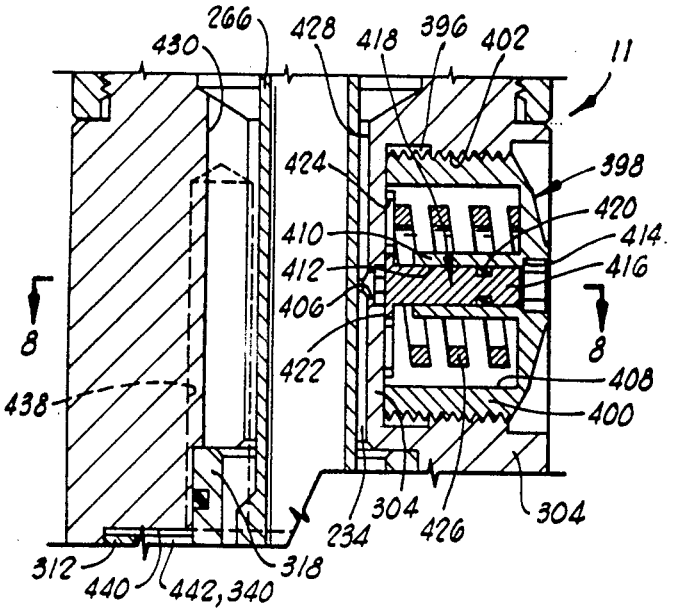
FIG. 7 is an enlarged area of a portion of FIG. 2E showing one embodiment of a pressure limiter.

Referring now also to the enlarged detail of FIG. 7, pressure limiter assembly 398 includes a pressure limiter housing 400 which is fixed in transverse cavity 396 by threaded connection 402. Pressure limiter housing 400 engages seat portion 404 of pressure limiter body 304. Seat portion 404, which defines a radially inner boundary of transverse cavity 396 defines a transverse hole 406 therethrough in communication with pumping chamber 234. Hole 406 opens into a central cavity 408.

From the outermost end of pressure limiter housing 400 a sleeve 410 extends radially inwardly into central cavity 408. Sleeve 410 defines a substantially cylindrical piston bore 412 therethrough with an inwardly extending shoulder 414 adjacent the outer end of the piston bore. Reciprocably disposed in piston bore 412 is a substantially cylindrical portion 416 of a pressure limiter piston 418. Cylindrical portion 416 of pressure limiter piston 418 slides within piston bore 418, and a seal 420 is provided therebetween.

Extending outwardly from cylindrical portion 416 of pressure limiter piston 418 is a flange portion 422 which defines a plurality of openings 424 therethrough. When pressure limiter piston 418 is in the closed position shown in FIGS. 2E and 7, flange portion 422 is in sealing engagement with seat portion 404 of pressure limiter body 304 such that hole 406 is closed. A spring 426 biases pressure limiter piston 418 to the closed position.

Figure 9:
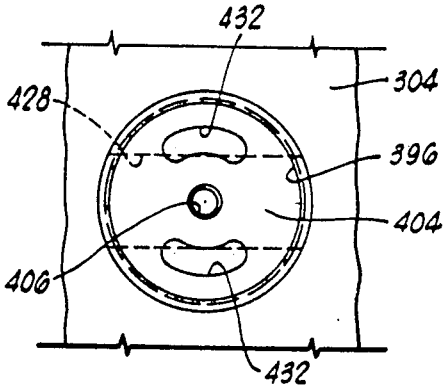
FIG. 9 is an elevation of the pressure limiter body as viewed from lines 9—9 in FIG. 8.
Figure 8:
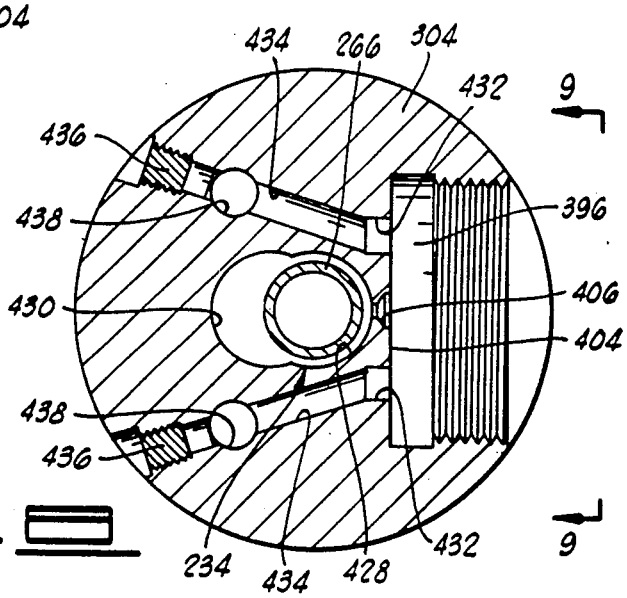
FIG. 8 is a cross section of the pressure limiter body taken along lines 8—8 in FIG. 7.

Referring now also to FIGS. 8 and 9, a bypass passageway system through pressure limiter body 304 is shown. In FIGS. 8 and 9, pressure limiter housing 400, pressure limiter piston 418 and spring 426 are removed for clarity. As already discussed, hole 406 through seat portion 404 of pressure limiter body 304 is in communication with pumping chamber 234, a portion of which is defined by the annulus between central bore 428 in pressure limiter body 304 and pump mandrel 266. An offset bore 430 is provided longitudinally in pressure limiter body 304 adjacent central bore 428 to insure a sufficiently large cross-sectional area of pumping chamber 234 at the longitudinal area adjacent pressure limiter assembly 398.

A pair of curvilinear slots 432, best shown in FIG. 9, are defined in seat portion 404 of pressure limiter body 304. Each of slots 432 is in communication with a substantially transversely oriented hole 434 extending angularly therefrom. A plug 436 closes off the outer end of each hole 434 and thus prevents communication between holes 434 and well annulus 284. Openings 424 in pressure limiter piston 418 and slots 432 in pressure limiter body 304 are adapted to be at least partially aligned at all times so that constant fluid communication is provided between holes 434 and central cavity 408 of pressure limiter housing 400.

Intersecting each transverse hole 434 is a longitudinally oriented hole 438 which extends upwardly from shoulder 440 in pressure limiter body 304. Holes 434 are shown in hidden lines in FIGS. 2E and 7. Holes 438 open into an upper portion 442 of outlet chamber 340. Thus, it will be seen that central cavity 408 of pressure limiter housing 400 is in fluid communication with outlet chamber 340. Further, when pressure limiter piston 418 is moved radially outwardly from seat portion 404 of pressure limiter body 304, pumping chamber 234 is also in fluid communication with outlet chamber 340, and thus outlet check valve means 338 is bypassed, as more fully described herein.

OPERATION OF THE INVENTION

Pumping chamber 201 and equalizing chamber 102 below equalizing piston 104 are precharged with lubricating oil through holes 235 and 114, respectively, as already described. As testing string 12 is lowered into well bore 14, equalizing piston 104 is preferably at the uppermost position in equalizing chamber 102, as shown in FIG. 2B.

Testing string 12 is lowered until upper packer 32 and lower packer 34 are properly positioned on opposite sides of formation 16. In this position, upper adapter means 42 is spaced above case means 54, as illustrated in FIGS. 2A and 2B. In other words, splined portion 70 of torque mandrel 60 is in contact with shoulder 69 in torque case 50.

Drag springs 40 at the lower end of testing string 12 help center the apparatus and further prevent rotation of the lower portion of testing string 12. Because case means 54 and lower mandrel means 196 are attached to the lower portion of testing string 12, and because the case means and lower mandrel means are prevented from mutual rotation by inner spline 244 in splined upper pump breakoff 237 and outer spling 244 on diaphragm mandrel 198, case means 54 and lower mandrel means 196 are also prevented from rotation by drag springs 40. Thus, it will be seen that rotation of tool string 18, the upper portion of testing string 12 including upper adapter means 42 and upper mandrel means 58 of pump 10 will rotate with respect to case means 54 and lower mandrel means 196 of pump 10.

As lower mandrel means 58 is rotated, pump cam 136 is rotated with respect to pump piston 166. Of course, rotation of pump piston 166 is prevented by the interaction of splines 176 on the pump piston with splines 178 in spline piston case 142 of case means 54. As pump cam 136 is rotated, cam roller 169 and cam follower pin 168 will be moved cyclically between upper portions 158 and lower portions 160 of cam slot 156, resulting in reciprocation of pump piston 166 within piston chamber 201. Because cam slot 156 has two upper portions 158 and two lower portions 160, pump piston 166 will be cycled twice for each revolution of pump cam 136.

Downward movement of piston 166 within piston chamber 201 causes fluid movement in lower portion 202 of piston chamber 201 against diaphragm 226. Diaphragm 226 will flex downwardly in response to this fluid movement, and thus there will be a corresponding fluid movement downwardly in pumping chamber 234. Although piston chamber 201 and pumping chamber 234 are sealingly separated by diaphragm 226, pumping action will occur in pumping chamber 234 just as if pump piston 166 were in direct contact with the fluid therein. Further, if diaphragm 226 is damaged or leaks, wiper rings 188 and 192 act as backups to the diaphragm by wiping piston 166 and pump cam 136 free of abrasives so that pump 10 will still function. In such a case, the lubricating fluid in piston chamber 201 will be lost, and pump piston 166 will be in contact with, and directly pump against, well annulus fluid from pumping chamber 234 in a manner similar to pumps in the prior art.

As pump piston 166 moves upwardly in piston chamber 201, one-way check valves 394 will allow fluid in upper portion 203 of piston chamber 201 to bypass downwardly therethrough so that undesired pressure is not built up in upper portion 203 of the piston chamber.

Thus, pump piston 166 pumps on the down stroke and bypasses on the up stroke of a reciprocation cycle.

When pump piston 166 is moved upwardly during a cycle, diaphragm 226 will correspondingly move upwardly. This results in a lowering of pressure in pumping chamber 234 below the fluid pressure in well annulus 284 which causes annular lip 296 of inlet check valve means 288 to deflect radially inwardly. Well annulus fluid thus enters pumping chamber 234 through hole 282, inlet chamber 280, intake screen 272, hole 286 and annular space 302. At the same time, fluid differential pressure across outlet check valve means 338 keeps annular lip 348 thereof sealingly enclosed. In other words, fluid only enters pumping chamber 234 through inlet check valve means 288.

On the down stroke of pump piston 166 in which diaphragm 226 is correspondingly moved downwardly, there is a resulting increase in pressure in pumping chamber 234. This increased pressure causes annular lip 296 of inlet check valve means 288 to be sealingly closed, and annular lip 348 of outlet check valve means 338 is opened by fluid flow from pumping chamber 234 through hole 336 and annular space 354 for discharge of the fluid from the pumping chamber into outlet chamber 340.

The continuous pumping action of pump piston 166 and diaphragm 226 thus causes pumping of fluid from well annulus 284 into outlet chamber 340 and from there downwardly through the lower portion of testing string 12 to inflate upper packer 32 and lower packer 34 into sealing engagement with well bore 14 adjacent well formation 16.

Once upper packer 32 and lower packer 34 are properly inflated, testing of fluids in well formation 16 may be carried out in a manner known in the art. Such fluids are carried upwardly through a central flow passageway in testing string 12 which includes central opening 444 of pump 10 and pressure limiter means 11.

When pump 10 is not in operation, such as when testing string 12 is lowered into well bore 14 or removed therefrom, a hydrostatic pressure differential between pumping chamber 234 and piston chamber 201 across diaphragm 226 could cause a rupture in the diaphragm. This is prevented by an interaction between equalizing piston 104 in equalizing chamber 102 and visco-jet 392 and check valves 394 in piston 166.

As already indicated, equalizing piston 104 is at the uppermost point in equalizing chamger 102 as testing string 12 is lowered into well bore 14. The increased fluid pressure in well bore 14 causes a compression of the lubricating oil in equalizing chamber 102 and piston chamber 201. As this occurs, equalizing piston 104 will move downwardly in equalizing chamber 102. Well annulus fluid will enter the equalizing chamber above piston 104 through opening 96 in piston cap 82. Because of check valves 394, this increase in fluid pressure in equalizing chamber 102, and thus upper portion 203 of piston chamber 201 will be communicated to lower portion 202 of piston chamber 201. Inlet check valve means 288 will open as necessary to equalize the hydrostatic pressures in pumping chamber 234 and well annulus 284. Thus, hydrostatic pressures on each side of diaphragm 226 are equalized.

As testing string 12 is raised to test a shallower formation 16 or is removed from well bore 14, the hydrostatic fluid pressure in pumping chamber 234, which will be basically well annulus pressure, will be greater than the hydrostatic pressure in lower portion 202 of piston chamber 201. Unless flow control means is provided for allowing some upward movement of fluid past pump piston 166, diaphragm 226 could be ruptured. Visco-jet 392 solves this problem by allowing retarded fluid movement upwardly past piston 166 from lower portion 202 to upper portion 203 of piston chamber 201. Equalizing piston 104 will respond accordingly. Thus, hydrostatic fluid pressure is again equalized on both sides of diaphragm 226 which eliminates the possibility of rupture. The amount of fluid flow through visco-jet 392 will be so retarded as to be basically negligible during the relatively rapid movement of pump piston 166 during operation of pump 10.

During pumping operation, it is desirable to limit the pressure output by pump 10 so that over-inflation of upper packer 32 and lower packer 34 is prevented. In the prior art, such pressure limitation has been typically provided by relief valves which bypass fluid directly from the pumping chamber to the well annulus. In the embodiment of pressure limiter means 11 disclosed herein, in which fluid is bypassed directly between the pumping chamber and the outlet chamber, and thus directly between the pumping chamber and the lower portion of testing string 12, does not vent to well annulus 284. This basically results in a greatly increased volume of pumping chamber 234. This greatly reduces the compression ratio of the volume of a stroke of pump piston 166 to the volume of the pumping chamber. However, even if pressure limiter means 11 becomes stuck in an open position, packers 32 and 34 will remain inflated because the fluid from the pumping chamber is not bypassed directly to the well annulus. In other words, the pumping system remains closed.

In the embodiment of pressure limiter means 11 shown in FIGS. 2E and 7–9, when the differential pressure between outlet chamber 340 and well annulus 284 exceeds a predetermined level, pressure limiter piston 418 will be moved to an open position away from seat portion 404 of pressure limiter body 304, thus opening hole 406 and providing communication between pumping chamber 234 and outlet chamber 340 through the fluid passageway system hereinbefore described. As long as fluid pressure in outlet chamber 340 is sufficiently greater than the fluid pressure in well annulus 284 to overcome the force of spring 426, pressure limiter piston 418 will remain opened, effectively bypassing outlet check valve means 338. A study of FIG. 7 will show that this fluid differential pressure acts across the area sealed by seal 420 in piston bore 412 of pressure limiter housing 400. When the force of the pressure differential across this area drops below the force of spring 426, piston 418 will move to its closed position sealingly engaged against seat portion 404 of pressure limiter body 304, thus again closing pressure limiter means 11.

Once testing of fluids in well formation 16 is completed, upper packer 32 and lower packer 34 are deflated by actuating packer bypass 226. Such a packer bypass 226 is described in co-pending application Ser. No. 940,882 filed 12/10/86, a copy of which is incorporated herein by reference. Other methods of deflating packers 32 and 34 known in the art may also be used, and pump 10 is not limited to any particular deflating method.

When it is desired to have rotation below pump 10, such as to operate safety joint 30 in a situation where the tool string is stuck, tool string 18 may be lowered until lugs 71 on torque case 50 of upper adapter means 42 engage lugs 98 on piston cap 82 of case means 54. When lugs 71 and 98 are so engaged, it will be seen that rotation of tool string 18 and adapter means 42 will result in rotation of case means 54 and the portion of testing string 12 below pump 10 and above safety joint 30. The torque applied by rotation in such a manner is generally sufficient to index safety joint 30 which is of a kind known in the art.

It will be seen, therefore, that the downhole pump in the testing apparatus of the present invention is well adapted to carry out the ends and advantages mentioned, as well as those inherent therein. While a presently preferred embodiment of the pump and a pressure limiter means therein have been described for the purposes of this disclosure, numerous changes in the construction and arrangement of the parts may be made by those skilled in the art. All such changes are encompassed within the scope and spirit of the appended claims.

What is claimed is:

1. A downhole pump comprising:

case means attachable to a lower testing string portion and defining a pumping chamber therein;

mandrel means connectable to an upper testing string portion for mutual rotation therewith and rotatable within said case means, said mandrel means comprising cam means thereon and said case means and said mandrel means defining a piston chamber therebetween;

piston means disposed in said piston chamber and having cam follower means thereon for following said cam means and reciprocating said piston means with respect to said case means in response to rotation of said mandrel means with respect to said case means;

diaphragm means sealingly positioned between said piston chamber and said pumping chamber and preventing fluid communication therebetween, whereby fluid movement in said pumping chamber is responsive to fluid movement in said piston chamber and;

pressure equalizing means for equalizing a hydrostatic fluid pressure in said pumping chamber with a hydrostatic fluid pressure in said piston chamber.

2. The pump of claim 1 further comprising:

inlet check valve means for allowing fluid flow from a well annulus into said pumping chamber; and outlet check valve means for allowing fluid flow from said pumping chamber to said lower testing string portion.

3. The pump of claim 2 wherein:

said inlet check valve means is characterized by a check valve with a resilient valve portion having an annular lip thereon sealingly engaged with a surface of said pumping chamber when said inlet valve is in a closed position; and said outlet check valve means is characterized by another check valve having a resilient valve portion with an annular lip sealingly engaged with a surface of said pumping chamber when in a closed position.

4. The pump of claim 1 further comprising pressure limiting means for limiting a pressure differential between said pumping chamber and a well annulus to a predetermined level when in an open position.

5. The pump of claim 4 wherein:

said pump is connected to an inflatable packer and adapted for inflation thereof into an inflated position engaging a well bore; and said packer remains inflated even if said pressure limiting means becomes stuck in said open position.

6. The pump of claim 4 further comprising:

inlet check valve means; and outlet check valve means;

wherein, said pressure limiting means is in communication with said pumping chamber between said inlet and outlet check valve means.

7. A downhole pump assembly comprising:

an outer case defining a longitudinally central opening therethrough and having a lower end adapted for attachment to a lower testing string portion, said outer case defining:

inlet passageway means for providing communication between said central opening and a well annulus; and outlet passageway means for providing communication between said central opening and said lower testing string portion;

an upper mandrel comprising: an upper end adapted for attachment to an upper testing string portion;

a lower end rotatably disposed in said central opening of said case such that a generally annular, downwardly opening piston chamber is defined between said upper mandrel and said case; and a cam on said lower end; and a generally annular piston reciprocably disposed in said piston chamber;

a cam follower on said piston and engageable with said cam for reciprocating said piston in response to relative rotation between said upper mandrel and said case;

a lower mandrel disposed in said central opening below said upper mandrel such that a generally annular, upwardly opening pumping chamber is defined between said lower mandrel and said case, said pumping chamber being adjacent said inlet and outlet passageway means, said lower mandrel having a fixed operating position with respect to said case;

an annular diaphragm sealingly disposed between said piston chamber and said pumping chamber and preventing fluid communication therebetween;

an inlet valve disposed across said inlet passageway;

an outlet valve disposed across said outlet passageway; and a volume of fluid filling said piston chamber;

wherein, as said upper mandrel is rotated with respect to said case, said piston is reciprocated in said piston chamber and generates fluid movement therein, thus causing a corresponding reciprocation of said diaphragm such that upward movement of said diaphragm results in fluid from said well annulus being drawn into said pumping chamber across said inlet valve and downward movement of said diaphragm results in fluid in said pumping chamber being discharged therefrom across said outlet valve.

8. The pump assembly of claim 7 further comprising bypass means in said piston for bypassing fluid thereby as said piston moves upwardly and preventing significant flow of said fluid thereby as said piston moves downwardly during a pumping cycle.

9. The pump assembly of claim 7 further comprising pressure limiting means in communication with said pumping chamber for venting said pumping chamber to said lower testing string portion when a differential between a fluid pressure in said outlet passageway adjacent said outlet valve and a well annulus pressure exceeds a predetermined level.

10. The pump assembly of claim 7 further comprising backup sealing means on said piston.

11. The pump assembly of claim 7 further comprising pressure equalizing means for equalizing hydrostatic pressure of fluid in said piston chamber with hydrostatic pressure of fluid in said pumping chamber.

12. The pump assembly of claim 11 wherein said pressure equalizing means is characterized by:

said case and upper mandrel further defining an equalizing chamber therebetween having an upper end in communication with said well annulus and a lower end in communication with said piston chamber;

an equalizing piston reciprocably disposed in said equalizing chamber and movable in response to a differential pressure thereacross; and sealing means on said equalizing piston for preventing communication between said upper and lower ends of said equalizer chamber.

13. The pump assembly of claim 12 further comprising a viscojet disposed in said piston for allowing restricted flow of fluid from below said piston to above said piston.

14. The pump assembly of claim 7 wherein said diaphragm includes an outer and an inner sealing portion, pump assembly further comprising:

an annular diaphragm body defining a longitudinal passageway therethrough and adapted for supporting said diaphragm such that:

sealing engagement is provided by said outer sealing portion between said body and said case; and sealing engagement is provided by said inner sealing portion between said body and said lower mandrel.

15. A downhole testing tool for use on a testing string in a well annulus and having a central flow passageway therethrough, said tool comprising:

a tester valve;

a pump defining a piston chamber and a pumping chamber therein and comprising:

a reciprocating piston positioned in said piston chamber;

diaphragm means sealingly separating said piston chamber and said pumping chamber, said diaphragm means being flexibly responsive to movement of said piston; and hydrostatic equalizing means for equalizing hydrostatic fluid pressure in said pumping chamber with hydrostatic fluid pressure in said piston chamber to prevent rupture of said diaphragm means;

a packer positionable in said well annulus above a formation to be tested, said packer being inflatable by said pump into sealing engagement with said well annulus and deflatable by upward movement of said testing string; and a porting sub positionable adjacent said formation for allowing well fluid flow therethrough into said central flow passageway during a testing operation.

16. The tool of claim 15 wherein said pump further comprises pressure limiting means for limiting a pressure differential between said pumping chamber and said annulus to a predetermined maximum value.

17. The tool of claim 16 wherein said pump further comprises resilient annular inlet and outlet valves for allowing fluid flow into and out of said pumping chamber, respectively.

18. The tool of claim 15 further comprising:

a packer bypass; and a string bypass.

* * * * *